United States Patent [19]

Patton et al.

[11] 4,130,965

[45] Dec. 26, 1978

[54] CHRISTMAS TREE HOLDER

[76] Inventors: Roy D. Patton, 221 Heritage Pl., Morresville, N.C. 28115; Frank P. Rietveld, 1314 Vickie Ln., Matthews, N.C. 28105

[21] Appl. No.: 830,098

[22] Filed: Sep. 2, 1977

[51] Int. Cl.[2] ..... A47G 33/12

[52] U.S. Cl. ..... 47/40.5; 248/524; 248/188.7

[58] Field of Search ..... 248/188.7, 523, 524, 248/525, 526; 47/40.5

[56] References Cited

U.S. PATENT DOCUMENTS

| | | | |
|---|---|---|---|
| 2,476,225 | 7/1949 | Schroeder | 47/40.5 |
| 2,679,994 | 6/1954 | Mellen | 248/526 X |
| 3,119,586 | 1/1964 | Hoffman | 248/524 |
| 3,231,227 | 1/1966 | Weining | 47/40.5 |
| 3,332,649 | 7/1967 | Morrison | 47/40.5 |
| 3,838,838 | 10/1974 | Seaman | 248/188.7 X |

*Primary Examiner*—William H. Schultz

*Attorney, Agent, or Firm*—Harry R. Dumont

[57] ABSTRACT

A stand of a generally hemispheric configuration base. A plurality of clamping legs are provided which are arcuately curved and pass through channels formed in the base. The legs will pass through the respective channels into gripping relationship with the tree trunk when it is inserted into a central containing body in the stand. Thus, the weight of the tree itself serves to locate, hold and place into operation the gripping legs of the combination.

10 Claims, 6 Drawing Figures

FIG. 2A
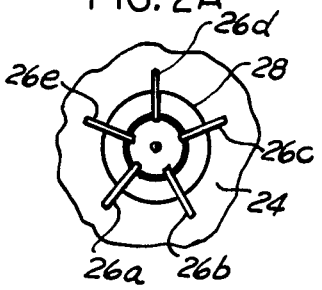
FIG. 2
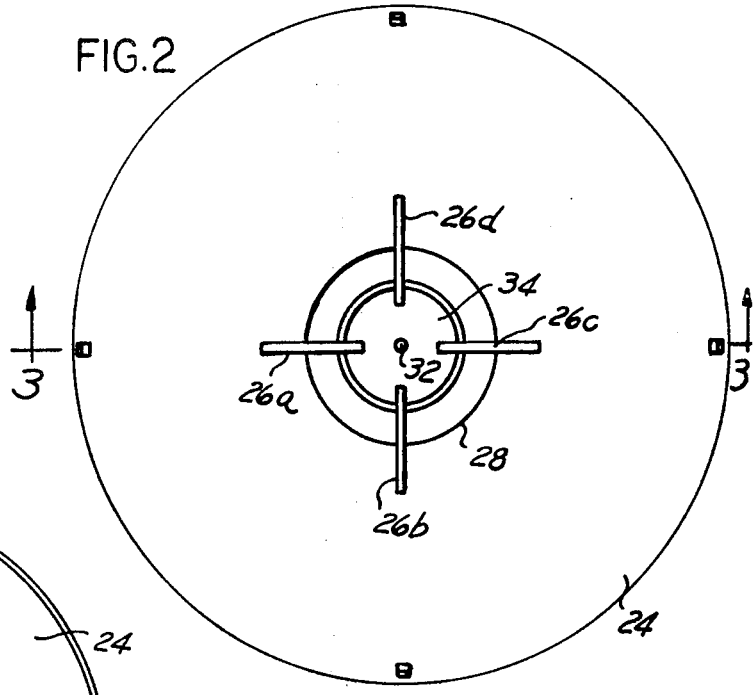
FIG. 5
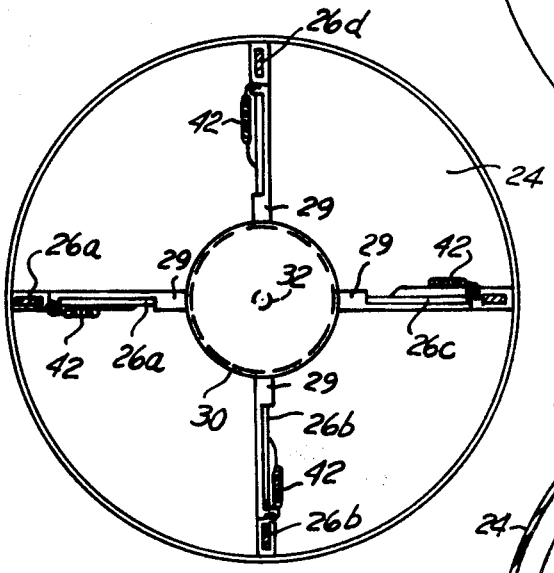
FIG. 3
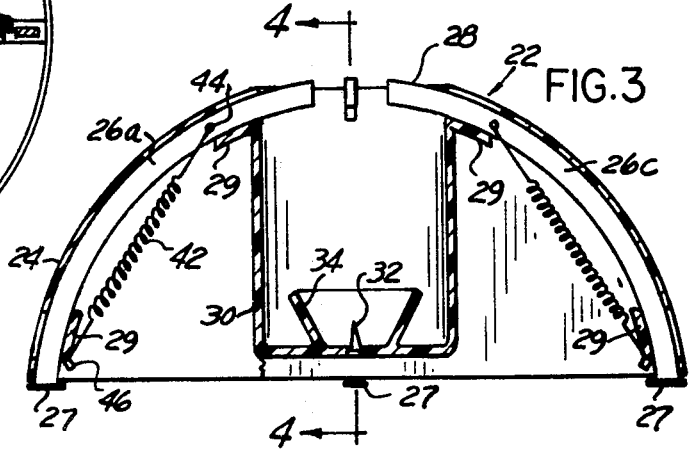
FIG. 1
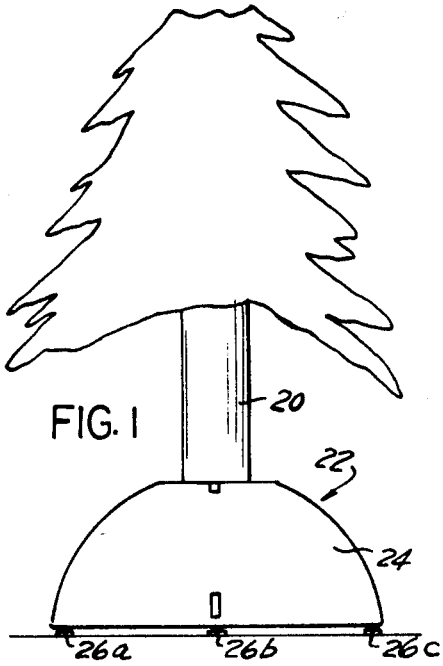
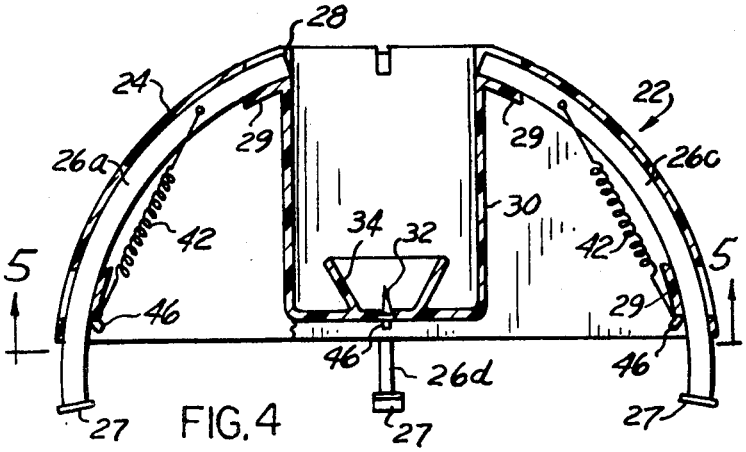
FIG. 4

CHRISTMAS TREE HOLDER

BACKGROUND OF THE INVENTION

This invention provides a symmetrical appearing and attractive stand for holding Christmas trees of a wide variety of trunk sizes and heights. There is a problem in providing a Christmas tree holder that is both simple, attractive to look at and easy to store in the unused condition. A number of prior art devices are known for holding Christmas trees in which the legs may be described as generally pivotally retained with a central tree trunk containing body and in which the locking is achieved through a tilting movement of each of the gripping legs. Examples of this type of Christmas tree holder are shown in Danner, U.S. Pat. No. 1,714,498 issued on May 28, 1929 for "Christmas Tree Holder", Krick, U.S. Pat. No. 694,867 issued on Mar. 4, 1902 for "Stand", Bailey, U.S. Pat. No. 873,402 issued on Dec. 10, 1907 for "Christmas Tree Holder", and Hollander, U.S. Pat. No. 2,014,896 issued on Sept. 17, 1935 for "Christmas Tree and Staff Holder".

BRIEF DESCRIPTION OF THE PRESENT INVENTION

The present invention provides a Christmas tree holder which is both simple and economical to manufacture and which represents a considerable improvement over the prior art with respect to its capability of holding a wide range of tree sizes. The combination of a generally hemispheric stand body with the arcuately formed and slidable clamping legs performs all the essential functions of just such an apparatus with considerable simplification of its parts.

BRIEF DESCRIPTION OF THE DRAWINGS

Reference is now made to the accompanying drawings forming a part of this specification in which similar characters and numerals of reference present corresponding parts in all the different figures and in which:

FIG. 1 is a partial side elevational view of the present invention showing a tree in place;

FIG. 2 is a top elevational view of the stand;

FIG. 2A is a fragmentary top elevational view showing a different embodiment of my invention;

FIG. 3 is a sectional view of the stand along the section line 3—3 of FIG. 2 with the legs shown in the operative or closed position;

FIG. 4 is a sectional view of the stand substantially similar to FIG. 2 and taken along the section line 4—4 of FIG. 3 but showing the legs in their open position; and FIG. 5 is a bottom plan view of the stand.

DETAILED DESCRIPTION OF THE PREFERRED EMBODIMENT

Reference is now made to FIG. 1 in which a Christmas tree 20 shown as it appears held by the stand 22. The stand 22 includes a generally hemispheric base 24 and a plurality of legs in the illustrated embodiment four in number with their lower ends extending and providing the function of supporting the body 24. It will be understood that the legs may be three or five as shown hereinafter in FIG. 2A or even more in number. The legs are identified by the numerals 26*a, b, c,* and *d.*

FIG. 2 shows the external appearance of the stand which is preferably formed from a high impact, fire resistant plastic material which may be pre-colored in any one or more of a variety of colors. The upper surface of the base 24 has formed in it a central opening 28 of a circular configuration which is adapted to receive the trunk of a tree being mounted. All of the four clamping legs 26*a–d* are shown moved inwardly toward the clamping position for holding a tree. As better shown in FIGS. 3 and 4, each of the legs 26*a–d* is slidably retained in a channel formed between the outer surface of the base 24 and inner members 29 extending in a curved path parallel to the path described by the outer body 24. The members 29 may be formed separately as shown with the upper members 29 formed integrally with a central reservoir 30. The reservoir 30 is constructed of a waterproof material such as metal or plastic and thus adapted to hold both the trunk of the tree and water to be added to keep the tree fresh. The reservoir 30 further includes an upwardly directed spike 32 fixed to its bottom at a central point adapted to anchor the trunk. An optional pilot 34 of a generally conical configuration may be included with or without the spike 32 for centering and holding. In either case, the lower end of the tree is held secure against dislodgement once it is placed in the tree holder 22.

FIG. 2A shows a different embodiment of my invention in which there are five legs 26*a–26e,* equidistantly disposed about the opening 28 to increase the holding capacity of the stand.

The detailed construction of the legs 26*a–d* is shown in FIGS. 3 and 4. Each of the several legs 26*a–d* includes at its lower end an enlarged tip 27 and at its upper end a pointed end.

A tension spring 42 is also associated with each leg for biasing it downwardly relative to the body 24. Each spring 42 is anchored at its upper end to an opening 44 formed in the associated leg and at its lower end on a lateral extension 46 formed in the respective member 29.

FIG. 4 shows the stand 22 in the preliminary opened position prior to the insertion of the tree trunk. In this condition the several legs 26*a–d* are drawn clear of the opening 28 formed at the upper end of the body 24. It will be seen that the insertion of the tree itself applies a weight under force transmitted through the reservoir 30 and the hemispherical body 24 sufficient to slide each of the several legs 26*a–d* upwardly through the arcuate channel which retains it into tight gripping and holding relationship with a tree trunk. If the forces applied by the several clamping legs 26*a–d* are not equal so that the tree is properly centered, it is possible for the person handling the stand to collectively press down in the direction of one or the other of the legs 26*a–d* thus to apply a greater force to that particular leg into the trunk.

When it is decided to remove the tree from the stand this can be accomplished simply by gripping several legs 26*a–d* by the tips 27 and withdrawing each of the legs from their gripping relationship with the trunk. Generally the tree removal can be made easier by lifting up on the tree while pushing down on the base 24 of the holder. This will assist in releasing the clamping action of the several legs 26*a–d* and freeing the tree. The stand according to the present invention is also readily adaptable for use on uneven floors in which adjustment can be made in the manner above described by selectively tightening and releasing the gripping action of one or more of the clamping legs 26*a–d.* The result of our invention is a substantially improved design for a tree stand which eliminates the need for adjusting screws, manipulated or nailed fasteners or the like and makes the holder itself self-adjusting. The holder becomes locked in holding relationship to the tree trunk largely through the weight of the tree itself and without the application of fixed fasteners to the trunk.

We claim:

1. A holder for a Christmas tree or the like comprising a base of generally hemispherical configuration; an opening formed centrally in the upper surface of said base; a plurality of arcuate channels at least three in number symmetrically disposed around the periphery of the base; a like arcuate configuration gripping leg slidably mounted in each of said channels, protruding from the bottom of the base and freely movable therethrough toward and away from the opening, a central reservoir with its upper end in communication with said opening for receiving the trunk of the tree and for applying a downward force to the base to provide a sliding movement of the several legs through their respective channels into gripping relationship with said tree trunk.

2. The combination as set forth in claim 1 wherein said reservoir includes at its lower closed end an upwardly directed spike for firmly anchoring the tree in said reservoir.

3. The combination as set forth in claim 1 wherein a hollow conical pilot member is mounted centrally in the reservoir to the surface of its base for centering and holding the trunk end of the tree being mounted.

4. The combination as set forth in claim 1 wherein each of said clamping legs includes a tip mounted at its lower end and in abutment with the surface of the floor.

5. The combination as set forth in claim 1 wherein the base is formed of high impact strength plastic material precolored with the dye color desired.

6. The combination as set forth in claim 1 wherein the legs are five in number to provide an equally centered combination of forces for holding the trunk of the tree in a secure vertical position.

7. The combination as set forth in claim 1 wherein said channels are formed each in a different web extending laterally between the reservoir and the outer surface of the base.

8. A holder for a Christmas tree or the like including a base; an opening formed in the top of the base; at least three arcuate shaped channels extending through said base intermediate the opening and its lower surface; a like arcuately shaped clamping leg slidably movable and retained in each of said channels; each of said legs having its lower end extending beyond said base lower surface; a reservoir likewise mounted in said base and in communication with the opening for receiving the trunk of the tree, said legs movable into said opening for gripping said trunk in tight holding relationship.

9. The combination as set forth in claim 8 wherein a pointed securing means is fixed and upwardly extending from the lower surface of the reservoir.

10. The combination as set forth in claim 8 wherein a hollow conical pilot member is secured to the bottom of said reservoir for centering and receiving the end of the tree trunk therein.

* * * * *